US009649656B2

(12) United States Patent
Brooks

(10) Patent No.: US 9,649,656 B2
(45) Date of Patent: May 16, 2017

(54) PAINT ROLLER HANDLE

(71) Applicant: Ryan T. Brooks, Pittsburgh, PA (US)

(72) Inventor: Ryan T. Brooks, Pittsburgh, PA (US)

( * ) Notice: Subject to any disclaimer, the term of this patent is extended or adjusted under 35 U.S.C. 154(b) by 463 days.

(21) Appl. No.: 14/034,997

(22) Filed: Sep. 24, 2013

(65) Prior Publication Data

US 2014/0261166 A1 Sep. 18, 2014

Related U.S. Application Data

(60) Provisional application No. 61/787,645, filed on Mar. 15, 2013.

(51) Int. Cl.

| | |
|---|---|
| ***B05C 17/02*** | (2006.01) |
| ***B25G 1/04*** | (2006.01) |
| ***B25G 1/10*** | (2006.01) |
| *A46B 5/02* | (2006.01) |
| *B25G 1/06* | (2006.01) |

(52) U.S. Cl.

CPC ..... *B05C 17/0205* (2013.01); *B25G 1/04* (2013.01); *B25G 1/066* (2013.01); *B25G 1/102* (2013.01); *A46B 5/02* (2013.01); *B25G 1/06* (2013.01); *Y10T 16/476* (2015.01)

(58) Field of Classification Search

CPC .... B25G 1/06; B25G 1/04; A46B 5/00; A46B 5/02; B05C 17/0205

USPC ..... 15/143, 144.1, 144.4; 16/426, 429, 438; 294/25

See application file for complete search history.

(56) References Cited

U.S. PATENT DOCUMENTS 4,888,846 A * 12/1989 Natale ..... A47L 13/022 15/143.1
5,379,758 A * 1/1995 Snyder ..... A61B 17/02 15/143.1
5,393,289 A * 2/1995 Green ..... B29C 66/8362 492/13
5,455,981 A * 10/1995 Wiese ..... A47L 13/022 15/143.1
5,471,698 A * 12/1995 Francis ..... A47L 13/08 15/144.1
5,529,357 A * 6/1996 Hoffman ..... A01B 1/026 15/145
5,890,259 A * 4/1999 Sarac ..... A01B 1/00 16/422
5,937,627 A * 8/1999 McKittrick ..... A01B 1/00 172/378
6,089,298 A * 7/2000 Tutewohl ..... B25F 1/00 156/579

(Continued)

FOREIGN PATENT DOCUMENTS

CA 2342462 A1 * 9/2001 ..... A46B 5/02

*Primary Examiner* — Michael Jennings

(74) *Attorney, Agent, or Firm* — The Webb Law Firm

(57) ABSTRACT

A paint roller includes a paint roller handle coupled to a proximal end of a paint roller frame and a paint applicator positioned on a distal end of the paint roller frame. The paint roller handle includes a first contact member positioned on a distal end of at least one distal frame member, a second contact member positioned on a proximal end of the at least one distal frame member, and a third contact member positioned on a proximal end of at least one proximal frame member. The proximal end of the at least one distal frame member is positioned on a distal end of the at least one proximal frame member.

6 Claims, 17 Drawing Sheets

(56) References Cited

U.S. PATENT DOCUMENTS

| | | | | |
|---|---|---|---|---|
| 6,286,396 | B1 * | 9/2001 | Johnson | B25B 9/00 81/177.2 |
| 6,408,479 | B1 * | 6/2002 | Pinney | B05C 17/022 15/144.1 |
| 6,435,284 | B1 * | 8/2002 | Aman | A01B 1/00 172/371 |
| 7,093,667 | B2 * | 8/2006 | Hurt | A01B 1/06 172/381 |
| D547,627 | S * | 7/2007 | Meads | D32/49 |
| 7,930,795 | B1 * | 4/2011 | Johnston | A47L 1/16 15/143.1 |
| 8,215,361 | B2 * | 7/2012 | Baughman | B29C 65/00 156/421 |
| 2002/0010975 | A1 * | 1/2002 | Walsh | A46B 5/02 15/230.11 |
| 2005/0050663 | A1 * | 3/2005 | Goulet | B05C 17/0205 15/144.4 |
| 2005/0229361 | A1 * | 10/2005 | Nicolay | A45F 5/00 16/436 |
| 2006/0123578 | A1 * | 6/2006 | Rickstrew | B05C 17/0205 15/230.11 |
| 2006/0174449 | A1 * | 8/2006 | Hughes | A61F 4/00 16/430 |

* cited by examiner

PAINT ROLLER HANDLE

CROSS REFERENCE TO RELATED APPLICATION

This application claims the benefit of U.S. Provisional Application No. 61/787,645, filed Mar. 15, 2013, which is hereby incorporated in its entirety by reference.

BACKGROUND OF THE INVENTION

Field of the Invention

This invention relates generally to paint rollers, and more particularly, to a handle for a paint roller.

Description of Related Art

Paint rollers traditionally include a paint roller frame with a paint applicator positioned on a distal end of the frame and a handle coupled to the proximal end of the frame. Basic handles include one cylindrical member that is gripped by the user when applying paint to a surface of a wall. Using this type of handle requires application of force directly to the handle, causing stress and discomfort on the user's wrist. Painters are commonly affected by Carpel Tunnel Syndrome which is caused by the repetitive motion of the wrist and hand when painting large surfaces. These basic handles require the application of force directed solely from the wrist of the user, thereby resulting in fatigue and injury to the user's wrist and hand. Only one point of contact is provided with traditional handles for paint rollers, thereby directing more force against a user's wrist and hand. These handles fail to use the movement and force that could be applied by the user through the use of his/her forearm and shoulder.

SUMMARY OF THE INVENTION

There is a current need for a paint roller that includes a paint roller handle that can relieve pressure on a user's wrist and forearm and provide extended periods of painting without discomfort.

In one embodiment, a paint roller handle includes a first contact member positioned on a distal end of at least one distal frame member, a second contact member positioned on a proximal end of the at least one distal frame member, and a third contact member positioned on a proximal end of at least one proximal frame member. The proximal end of the at least one distal frame member is positioned on the distal end of the at least one proximal frame member.

In another embodiment, a paint roller includes a paint roller handle coupled to a proximal end of a paint roller frame and a paint applicator positioned on a distal end of the paint roller frame. The paint roller handle includes a first contact member positioned on a distal end of at least one distal frame member, a second contact member positioned on a proximal end of the at least one distal frame member, and a third contact member positioned on a proximal end of at least one proximal frame member. The proximal end of the at least one distal frame member is positioned on a distal end of the at least one proximal frame member.

The at least one proximal frame member can be pivotally coupled to the at least one distal frame member. The first contact member can be a cylindrical grip. At least one of the second contact member and the third contact member can be cylindrical. The second contact member can have a curved bottom surface with a padding member, and the third contact member can have a curved top surface with a padding member. An attachment member, with a threaded hole adapted for coupling to an extension pole, can be positioned on a top surface of the second contact member. A threaded, recessed hole can be included in the first contact member, configured to accept a threaded end of an extension pole. The paint roller handle can include a spring positioned between the at least one distal frame member and the at least one proximal frame member, wherein the spring can be biased against the at least one proximal frame member or the at least one distal frame member creating a spring-loaded relationship between the at least one distal frame member and the at least one proximal frame member. The paint roller handle can include a second distal frame member and a second proximal frame member, and adjusting knobs positioned on the ends of the second contact member. A distal end of the second distal frame member can be positioned on the first contact member, and a proximal end of the second distal frame member can be positioned on the second contact member. A distal end of the second proximal frame member can be positioned on the second contact member, and a proximal end of the second proximal frame member can be positioned on the third contact member. The proximal ends of the distal frame members and the distal ends of the proximal frame members can be positioned between the adjusting knobs and the ends of the second contact member. Finger grip indentations can be included on a top surface of the first contact member, a bottom surface of the first contact member, or top and bottom surfaces of the first contact member. The at least one distal frame member, the second distal frame member, the at least one proximal frame member, the second proximal frame member, and the first, second, and third contact members can be formed in one continuous, integral piece. The at least one distal frame member can be continuous and integral with the at least one proximal frame member. The second distal frame member can be continuous and integral with the second proximal frame member. A threaded, recessed hole can be included in the first contact member, configured to accept a threaded proximal end of the paint roller frame. Different sized paint applicators can also be removed and installed on the distal end of the paint roller frame.

DESCRIPTION OF THE PREFERRED EMBODIMENTS

For purposes of the description hereinafter, spatial orientation terms, as used, shall relate to the referenced embodiment as it is oriented in the accompanying drawings, figures, or otherwise described in the following detailed description. However, it is to be understood that the embodiments described hereinafter may assume many alternative variations and configurations. It is also to be understood that the specific components, devices, features, and operational sequences illustrated in the accompanying drawings, figures, or otherwise described herein are simply exemplary and should not be considered as limiting.

Figure 1A:
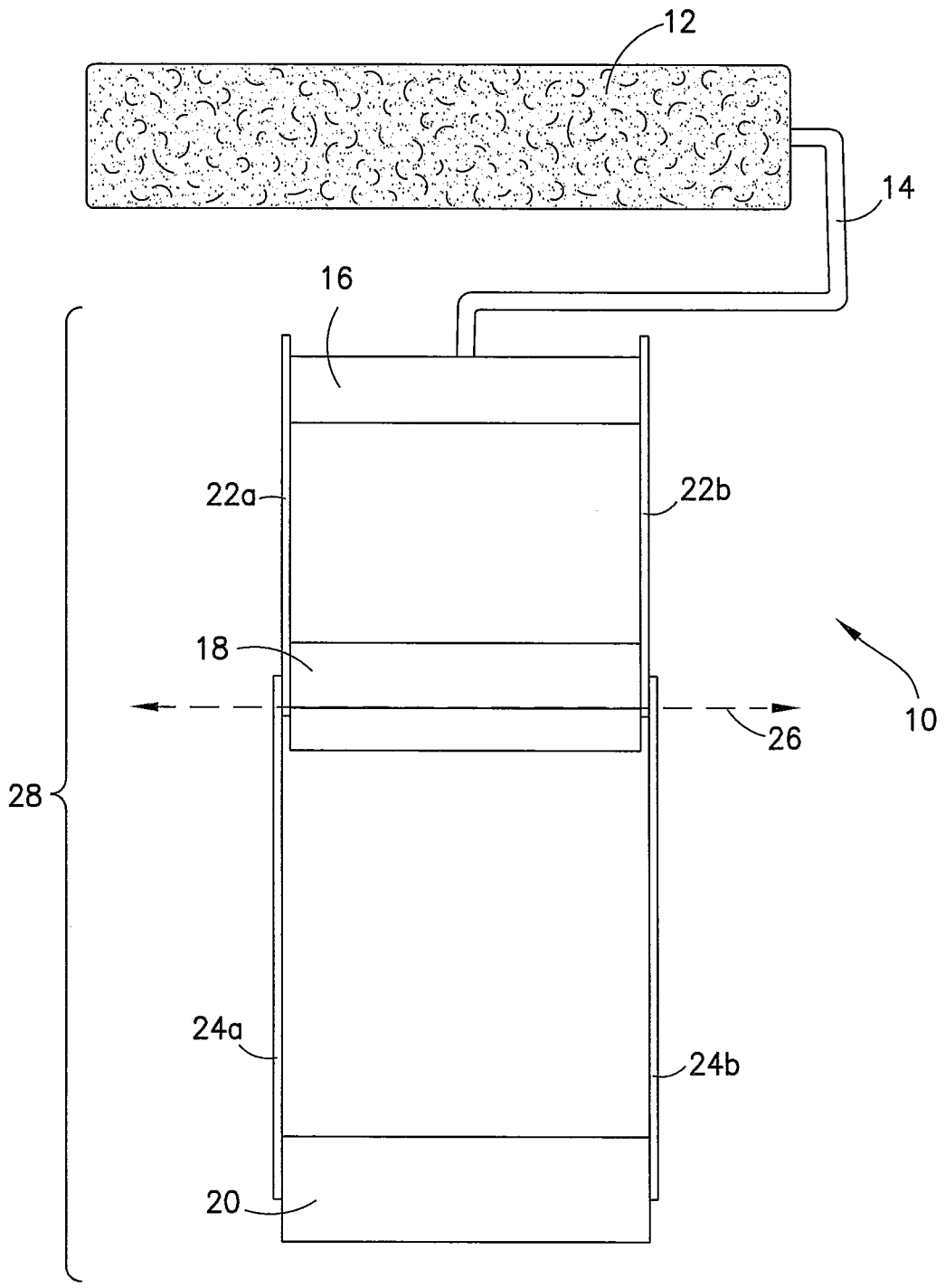
FIGS. 1A and 1B are top views of paint rollers in accordance with this disclosure.

Referring to FIG. 1A, a paint roller 10 is described in detail herein. A paint roller frame 14 is coupled to a paint roller handle 28. The paint roller frame 14 has a proximal end that is coupled to a first contact member 16 of the paint roller handle 28. The proximal end of the paint roller frame 14 can be coupled to the first contact member 16 at a single point, i.e., the center of the first contact member 16, or at multiple points on the first contact member 16. A distal end of the paint roller frame 14 is adapted to support a paint applicator 12 on the outer surface of the paint roller frame 14. The paint applicator 12 is cylindrical in shape and may comprise any absorbent material commonly used for painting, i.e., fabric, foam, lamb's wool or mohair. The paint roller frame 14 is press fit into the first contact member 16, but it is contemplated that alternative means of coupling the paint roller frame 14 to the first contact member 16 can be used, such as welding or fastening, among others.

The paint roller handle 28 comprises three contact members 16, 18, 20 that allow a user of the paint roller 10 to rely on the movement and force from his/her shoulder rather than his/her wrist. The paint roller handle 28, in essence, becomes an extension of the user's forearm and hand. The first contact member 16 is coupled to, in addition to the paint roller frame 14, distal ends of two distal frame members 22*a*, 22*b*. Each distal frame member 22*a*, 22*b* is coupled to a corresponding end of the first contact member 16. The first contact member 16 is cylindrical in shape, but additional shapes and sizes are contemplated. The first contact member 16 acts as a gripping member for the user when using the paint roller 10, which allows for greater control and accuracy when using the paint roller 10. The distal frame members 22*a*, 22*b* are generally rectangular in shape and extend between the first contact member 16 and a second contact member 18.

Figure 4A:
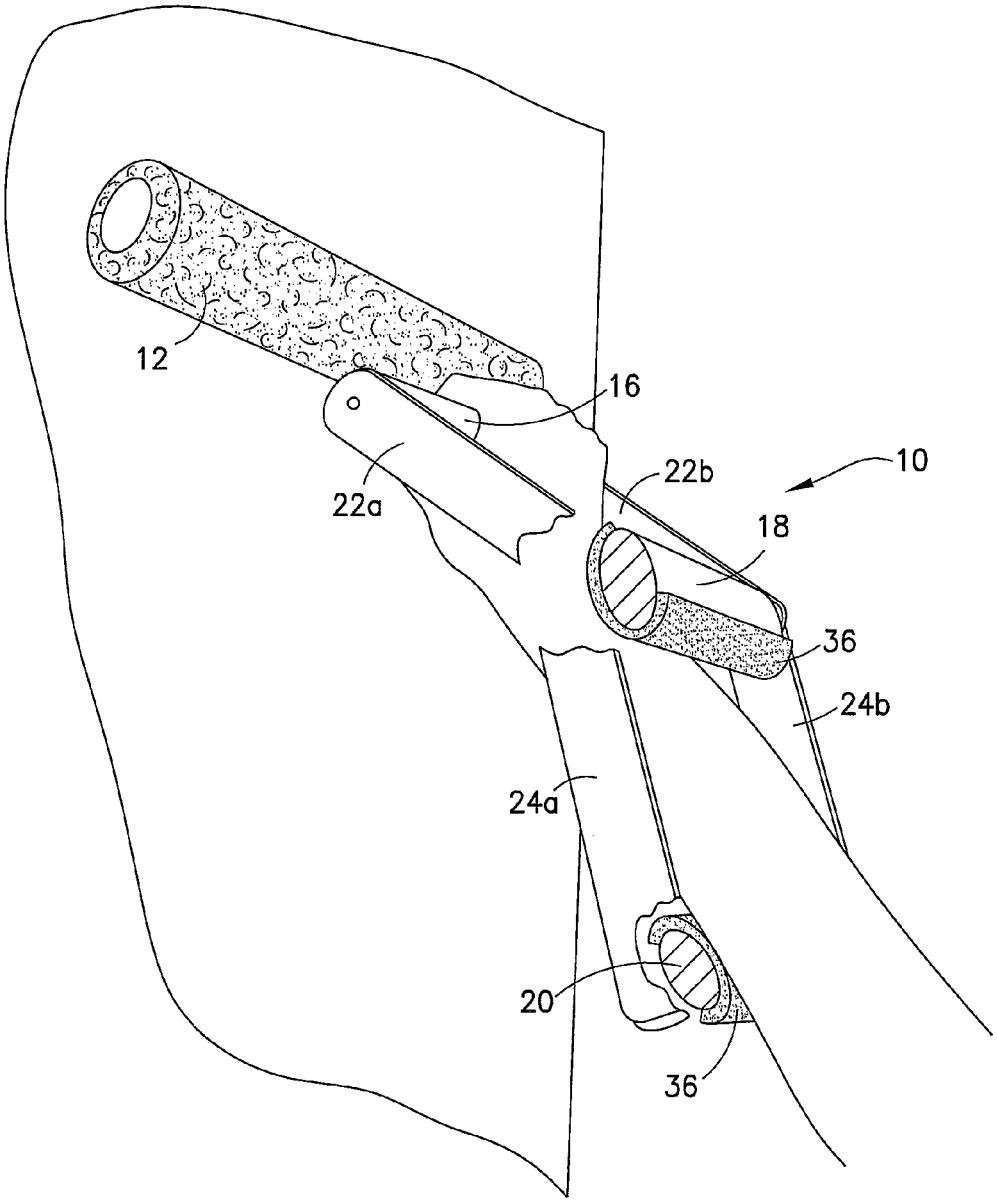
FIGS. 4A and 4B are perspective views of a paint roller with curved contact members, including padding on the contact members.
Figure 4B:
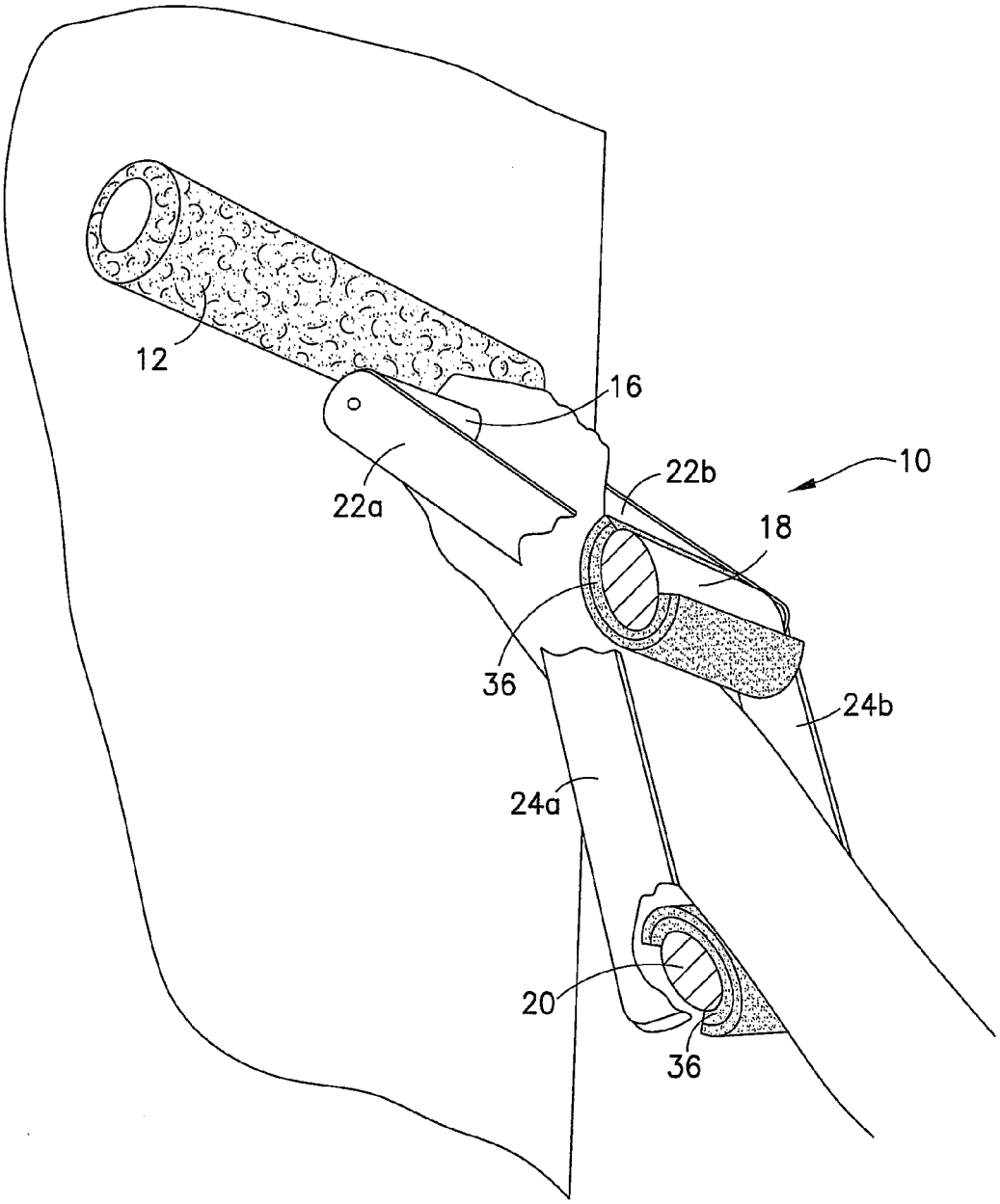

The second contact member 18 is coupled to proximal ends of the distal frame members 22*a*, 22*b*. Each distal frame member 22*a*, 22*b* is connected to a corresponding end of the second contact member 18. The second contact member 18 has a square cross-sectional shape, but alternative shapes and sizes are contemplated, such as cylindrical. In one embodiment, the proximal ends of the two distal frame members 22*a*, 22*b* are positioned in between the corresponding ends of the second contact member 18 and distal ends of two proximal frame members 24*a*, 24*b*. In an alternative embodiment, the distal ends of the proximal frame members 24*a*, 24*b* can be positioned in between the corresponding ends of the second contact member 18 and the proximal ends of the distal frame members 22*a*, 22*b*. The proximal frame members 24*a*, 24*b* are generally rectangular in shape and extend between the second contact member 18 and a third contact member 20. As shown in FIGS. 4A and 4B, a bottom surface of the second contact member 18 can also be curved to provide additional comfort to the user when resting his/her forearm on the second contact member 18. The bottom surface of the second contact member 18 can also include padding 36 to provide additional comfort. The padding 36 can be foam, rubber, or any other material that provides a comfortable resting position for the user.

The third contact member 20 is coupled to corresponding proximal ends of the proximal frame members 24*a*, 24*b*. The third contact member 20 has a square cross-sectional shape, but alternative shapes and sizes for the third contact member 20 are contemplated, such as cylindrical. As shown in FIGS. 4A and 4B, a top surface of the third contact member 20 can also be curved to provide additional comfort to the user when resting his/her forearm on the third contact member 20. The top surface of the third contact member 20 can also include padding 36 to provide additional comfort. The padding 36 can be foam, rubber, or any other material that provides a comfortable resting position for the user. Multiple layers of padding 36 can be used to provide additional comfort and to provide a firm, secure fit for the user's forearm when using the paint roller 10. The contact members 16, 18, 20 are preferably made of wood, but it is contemplated that the contact members 16, 18, 20 could be made of plastic, metal, or any other suitable material to provide a strong, sturdy contact member. The frame members 22*a*, 22*b*, 24*a*, 24*b* are preferably made of metal, but it is contemplated that alternative materials could be used, such as plastic and wood, among others. The contact members 16, 18, 20 are coupled to the frame members 22*a*, 22*b*, 24*a*, 24*b* via suitable fasteners, such as screws or nuts and bolts, that allow the frame members 22*a*, 22*b*, 24*a*, 24*b* to rotate for adjustment and comfort purposes in relation to one another.

Figure 1B:
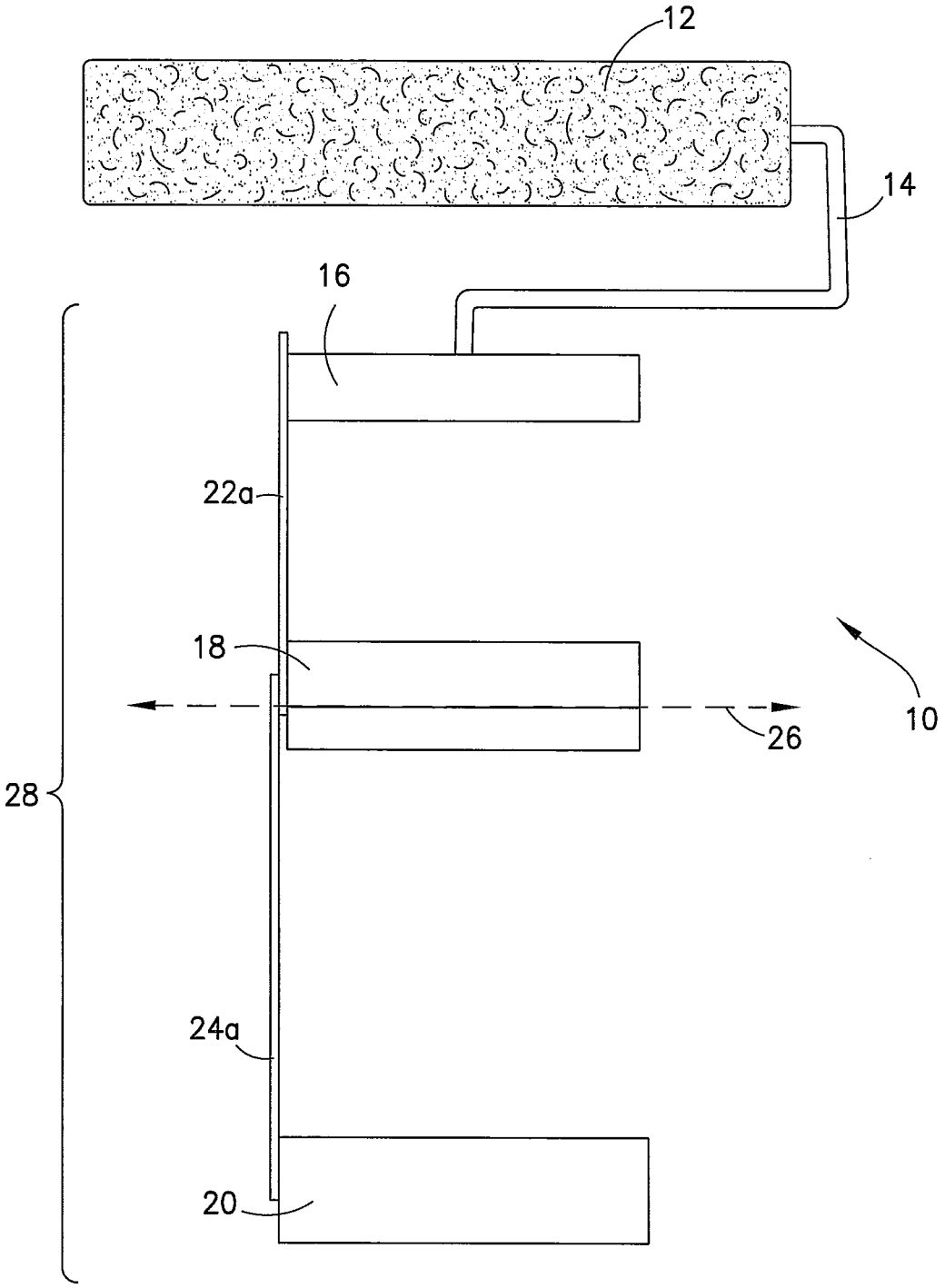
Figure 2A:
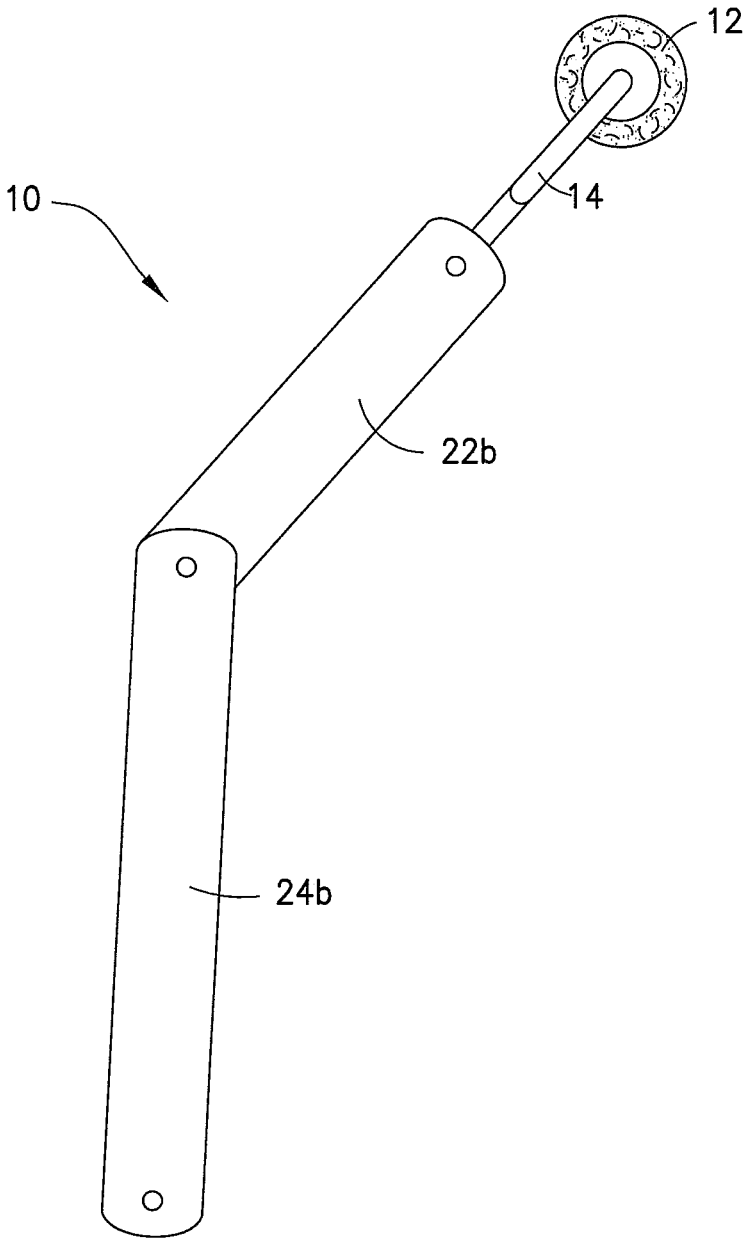
FIGS. 2A and 2B are side views of different embodiments of the paint roller shown in FIG. 1A.
Figure 2B:
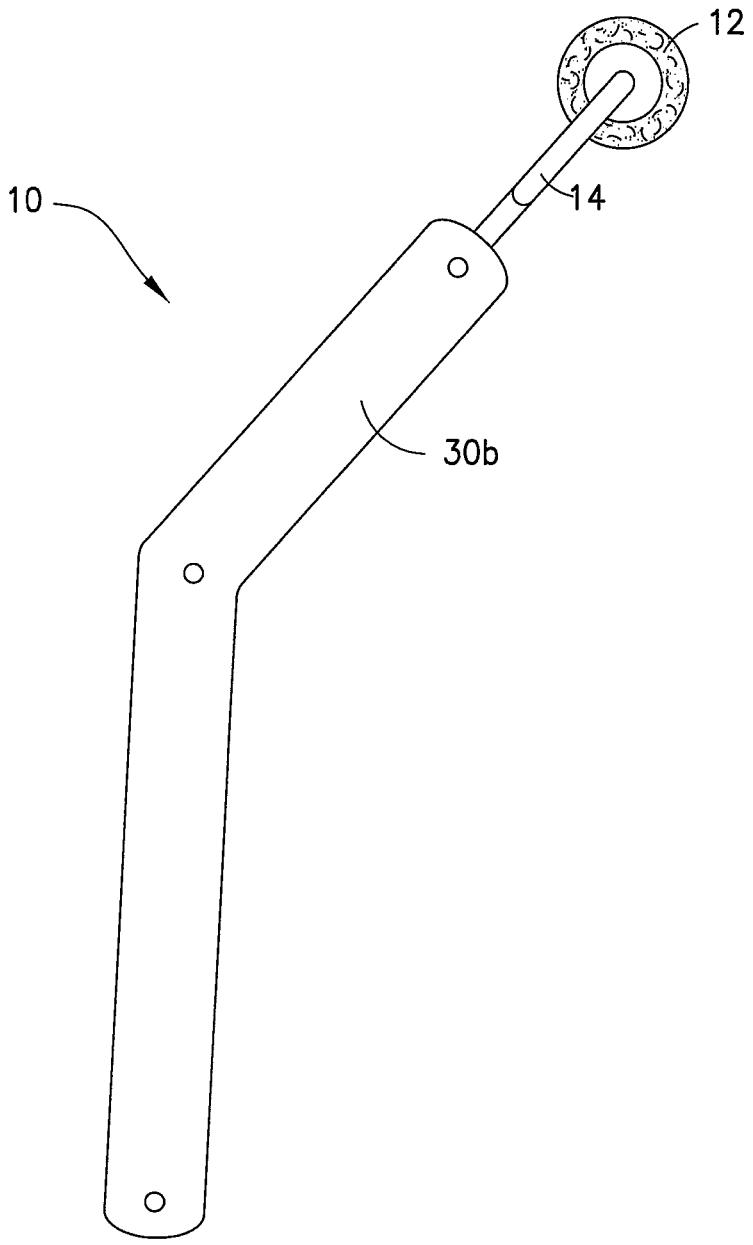
Figure 11:
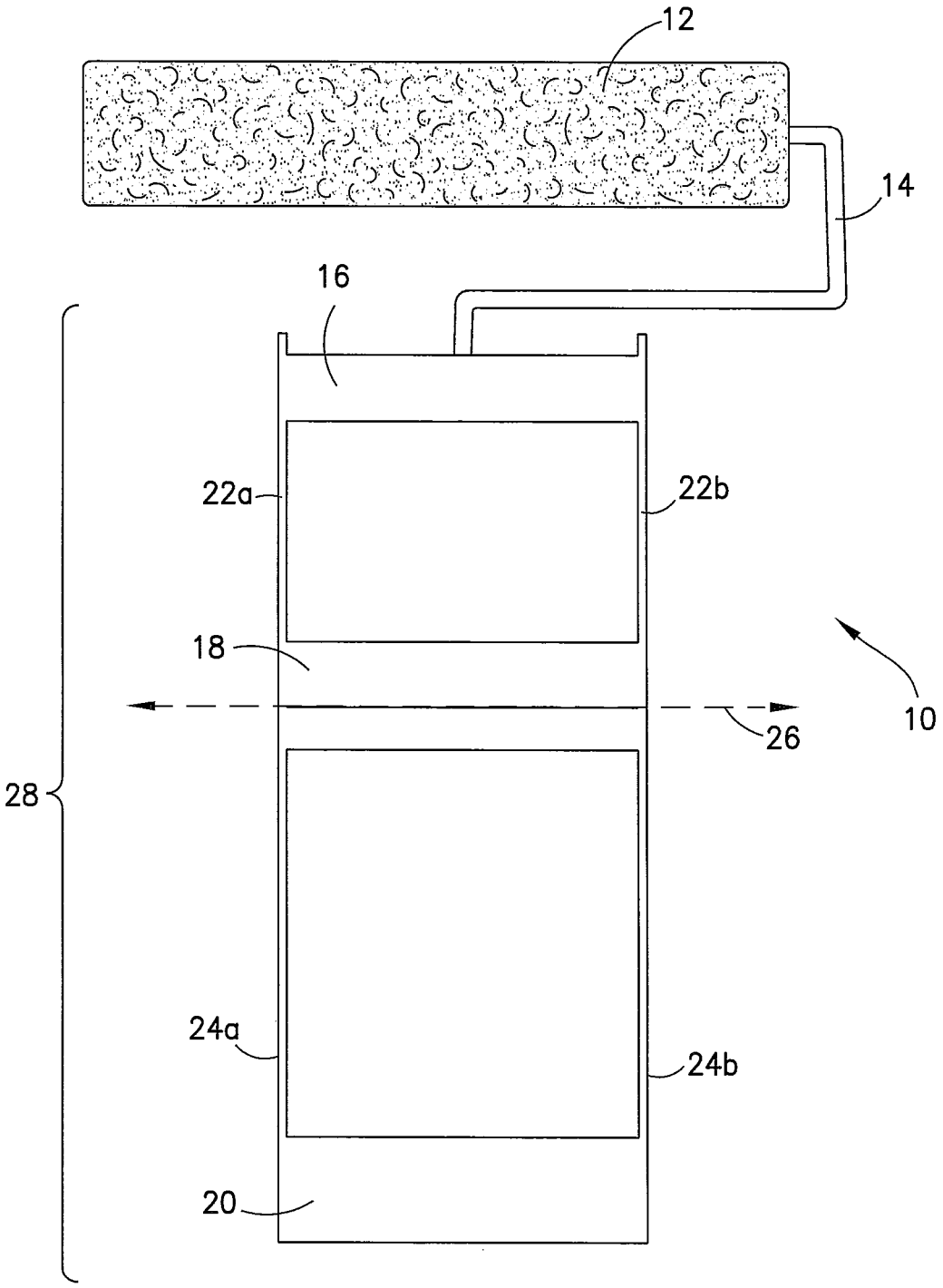
FIG. 11 is a perspective view of a paint roller with an integral, single piece paint roller handle.

In an alternative embodiment, as shown in FIG. 1B, the paint roller handle 28 can include only one distal frame member 22*a* and one proximal frame member 24*a*. Both of the frame members 22*a*, 24*a* can be positioned on the same side of the paint roller handle 28 and can couple to the same lateral end on each contact member 16, 18, 20. This arrangement provides a greater ease of use whenever a user is handling the paint roller 10. This allows the user to more easily insert his/her hand and forearm into the paint roller handle 28. In another alternative embodiment, shown in FIG. 2B, the paint roller 10 can include just one single, continuous frame member 30*b* on either side of the paint roller handle 28. This arrangement provides a fixed position for the paint roller handle 28, as the frame members 30*b* cannot rotate in relation to one another. As shown in FIG. 11, it is also contemplated that the entire paint roller handle 28 may be one continuous, integral piece, thereby providing greater stability and strength to the paint roller 10.

Figure 3:
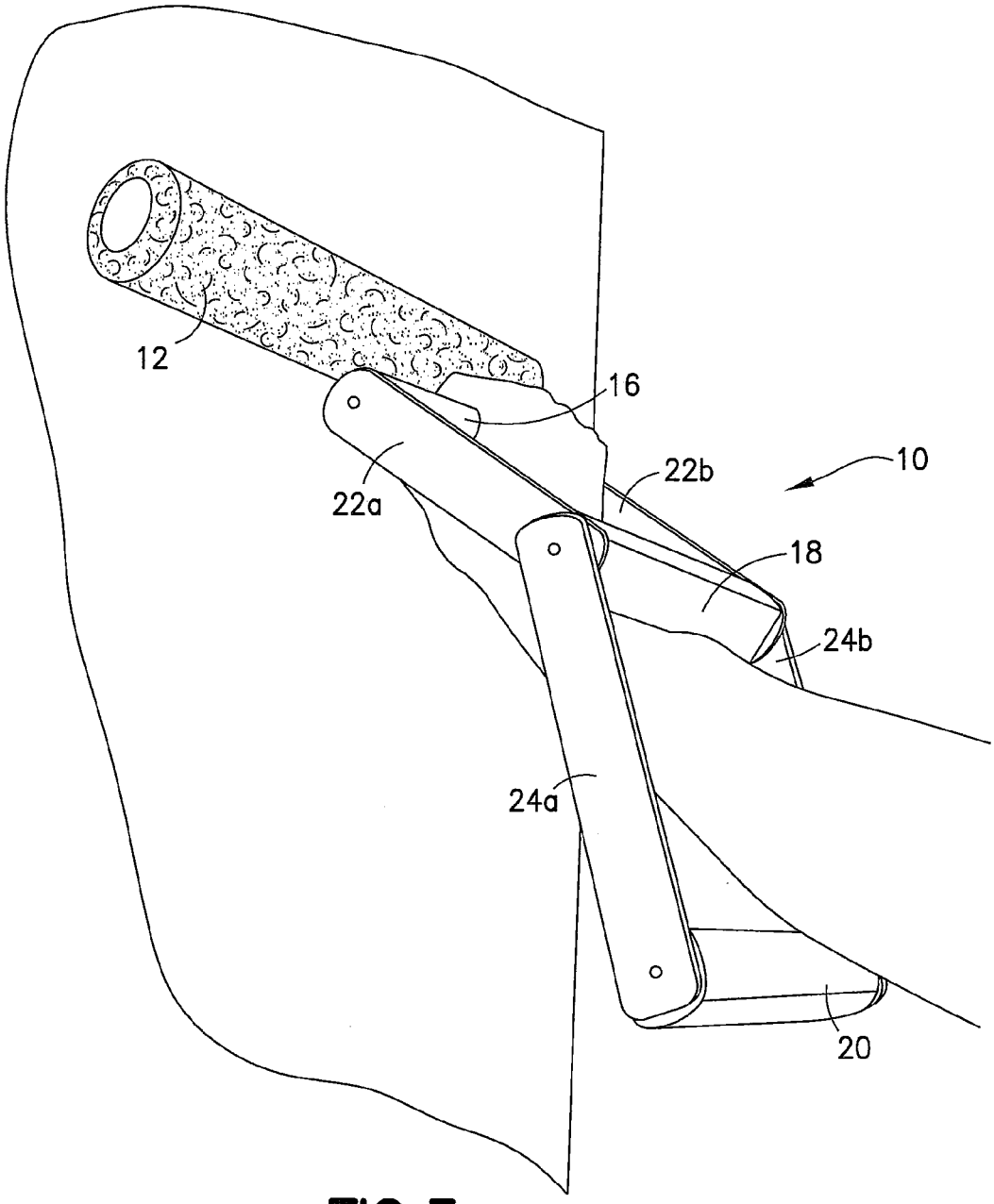
FIG. 3 is a perspective view of the paint roller shown in FIG. 1A in use by an individual.

In reference to FIG. 3, the paint roller 10 is designed to provide three separate points of contact on the user's forearm and wrist when using the paint roller 10 for an extended period of time. The paint roller handle 28 removes pressure from the user's wrist, eliminating discomfort and allowing the user to apply heavier and more prolonged pressure to the paint roller 10. When using the paint roller 10, the user inserts his/her hand over the third contact member 20, under the second contact member 18, and grips the first contact member 16. The first contact member 16 is the closest point of contact to the paint applicator 12 and is useful to keep the paint roller 10 attached to the user while in use. The second point of contact 18 is provided on a top surface of the user's forearm near the wrist. The third point of contact 20 is provided on a bottom surface of the user's forearm. As the paint roller 10 is moved up and down along a desired wall for painting, the movement and force are provided from the user's shoulder rather than just his/her wrist. This relieves pressure on the user's Wrist and allows for extended periods of painting. In one embodiment, the second contact member 18 and/or the third contact member 20 are rotatable about their longitudinal axes. This arrangement provides an easier and more comfortable way for a user to insert his/her arm into the paint roller handle 28. As the user inserts his/her arm through the paint roller handle 28, the second and third contact members 18, 20 rotate with the contact from the user's arm, thereby decreasing the amount of friction generated between the contact members and the user's arm. Once the user has properly inserted his/her arm in the paint roller handle 28, the second and third contact members 18, 20 stop rotating and remain stationary to hold the user's arm in place during operation.

Figure 12B:
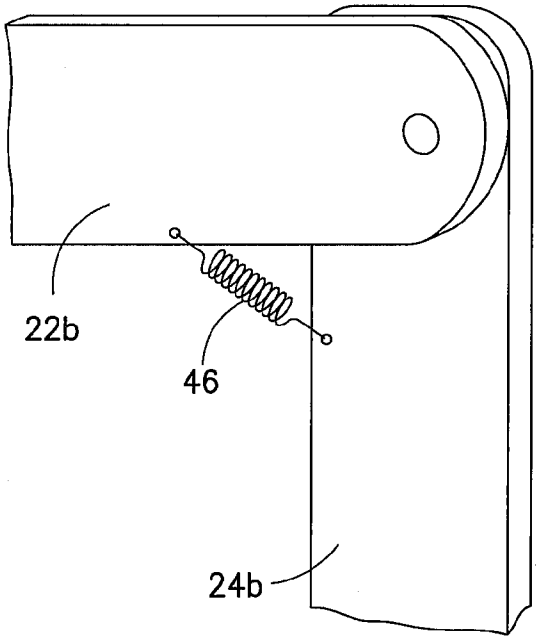
FIGS. 12A and 12B are perspective views of a spring-loaded paint roller handle in accordance with this disclosure.
Figure 12A:
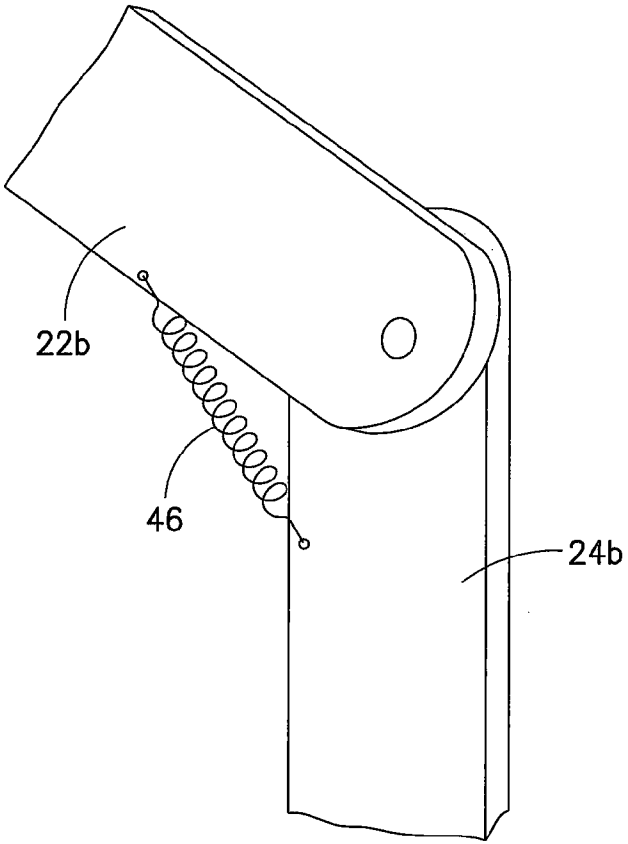

In reference to FIG. 3, the paint roller handle 28 can be adjusted to accommodate many different shapes and sizes of different users' forearms. The proximal frame members 24*a*, 24*b* are designed to rotate about the longitudinal axis of the second contact member 18. This allows the user to adjust the angle of the proximal frame members 24*a*, 24*b* in relation to the second contact member 18. Depending on the size of the user's forearm and the position of the wall that needs to be painted, the user may wish to position the paint roller handle 28 with the proximal frame members 24*a*, 24*b* at a smaller angle in relation to the distal frame members 22*a*, 22*b*. This configuration provides the user with an easier way to insert his/her hand and forearm into the paint roller handle 28. A greater clearance area between the second contact member 18 and the third contact member 20, in relation to the first contact member 16, allows the user to more easily grip the first contact member 16. In an alternative embodiment, the proximal frame members 24*a*, 24*b* can be spring-loaded to assist in the insertion of the user's arm into the paint roller handle 28. As shown in FIGS. 12A and 12B, a spring 46 can be positioned between the distal frame members 22*a*, 22*b* and the proximal frame members 24*a*, 24*b* to bias the frame members 22*a*, 22*b*, 24*a*, 24*b* into a desired operating arrangement. In one embodiment, the spring 46 creates a pivoting, spring-loaded relationship between the distal members 22*a*, 22*b* and the proximal frame members 24*a*, 24*b*. The expansion of the spring 46 creates a larger clearance for which a user can insert his/her arm through the second and third contact members 18, 20. Once the user's arm is inserted through the paint roller handle 28 and properly situated, the resilient spring 46 will spring back into its original position, thereby providing a secure fit for the user's arm.

Figure 5:
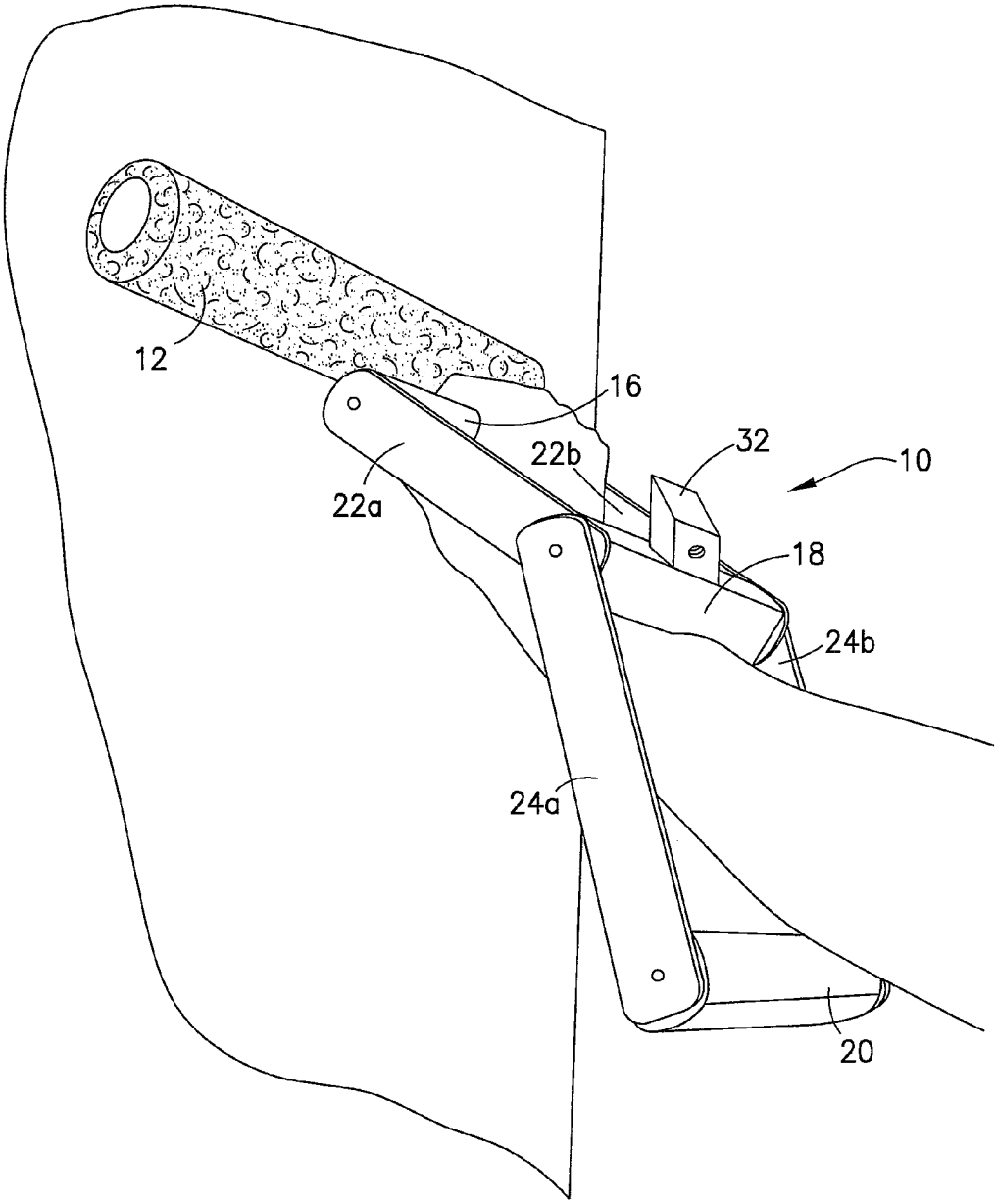
FIG. 5 is a perspective view of a paint roller with an attachment member adapted for receiving an extension pole.
Figure 6:
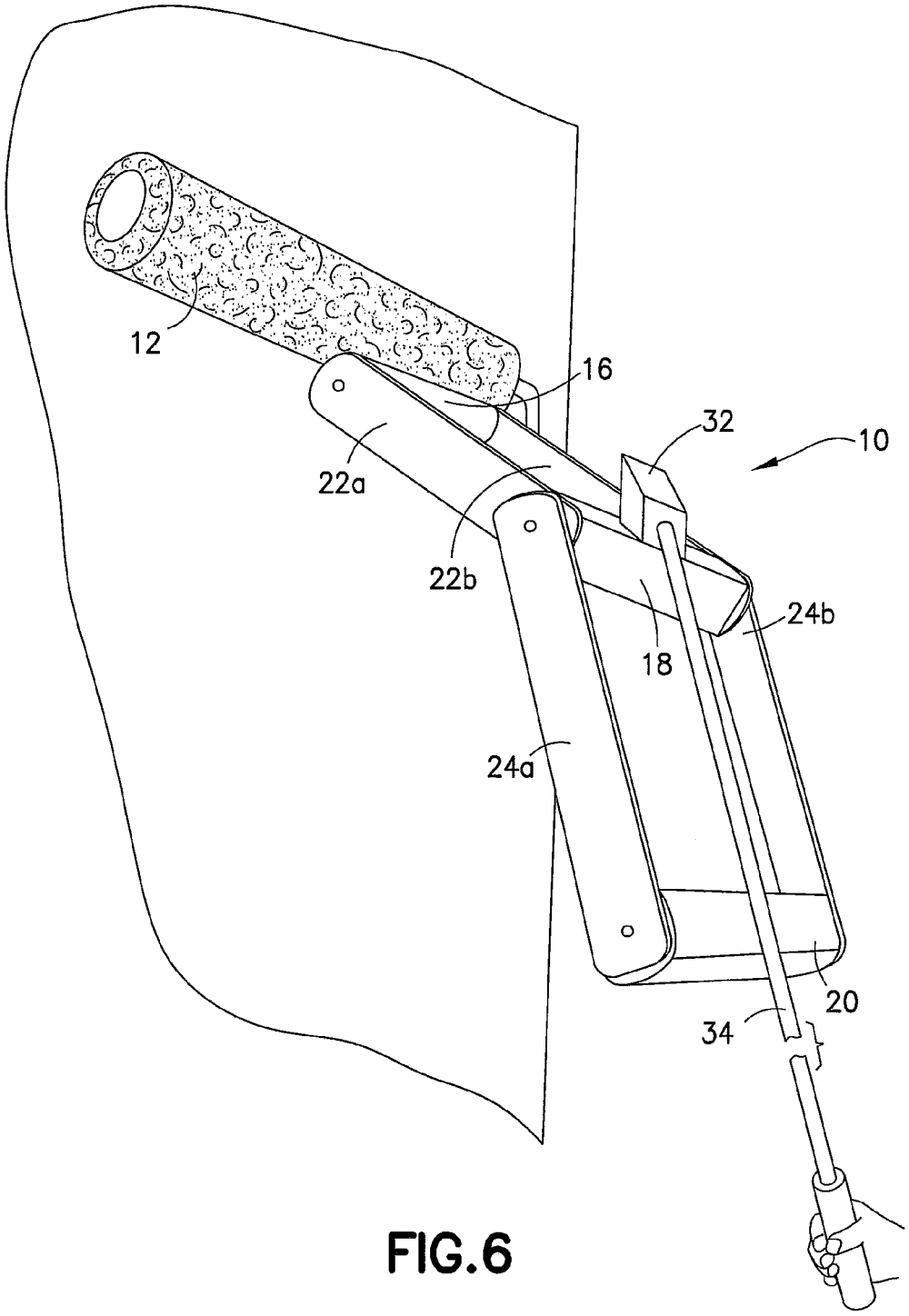
FIG. 6 is a perspective view of a paint roller used in conjunction with an extension pole.

As shown in FIGS. 5 and 6, the paint roller 10 can also be adapted to include an attachment member 32 on a top surface of the second contact member 18, which is adapted to receive an extension pole 34. This arrangement allows the user to reach and paint higher locations that would otherwise be inaccessible. The extension pole 34 includes a threaded male end that is screwed into a threaded female hole on the attachment member 32. The extension pole 34 can either be one single element or a plurality of elements in a telescopic relationship. In an arrangement where the extension pole 34 includes a plurality of elements in a telescopic relationship, the user can collapse the extension pole 34 into a smaller configuration for easier storage and/or transportation. It is also contemplated that the attachment member 32 could also be positioned on the third contact member 20, if desired.

Figure 7A:
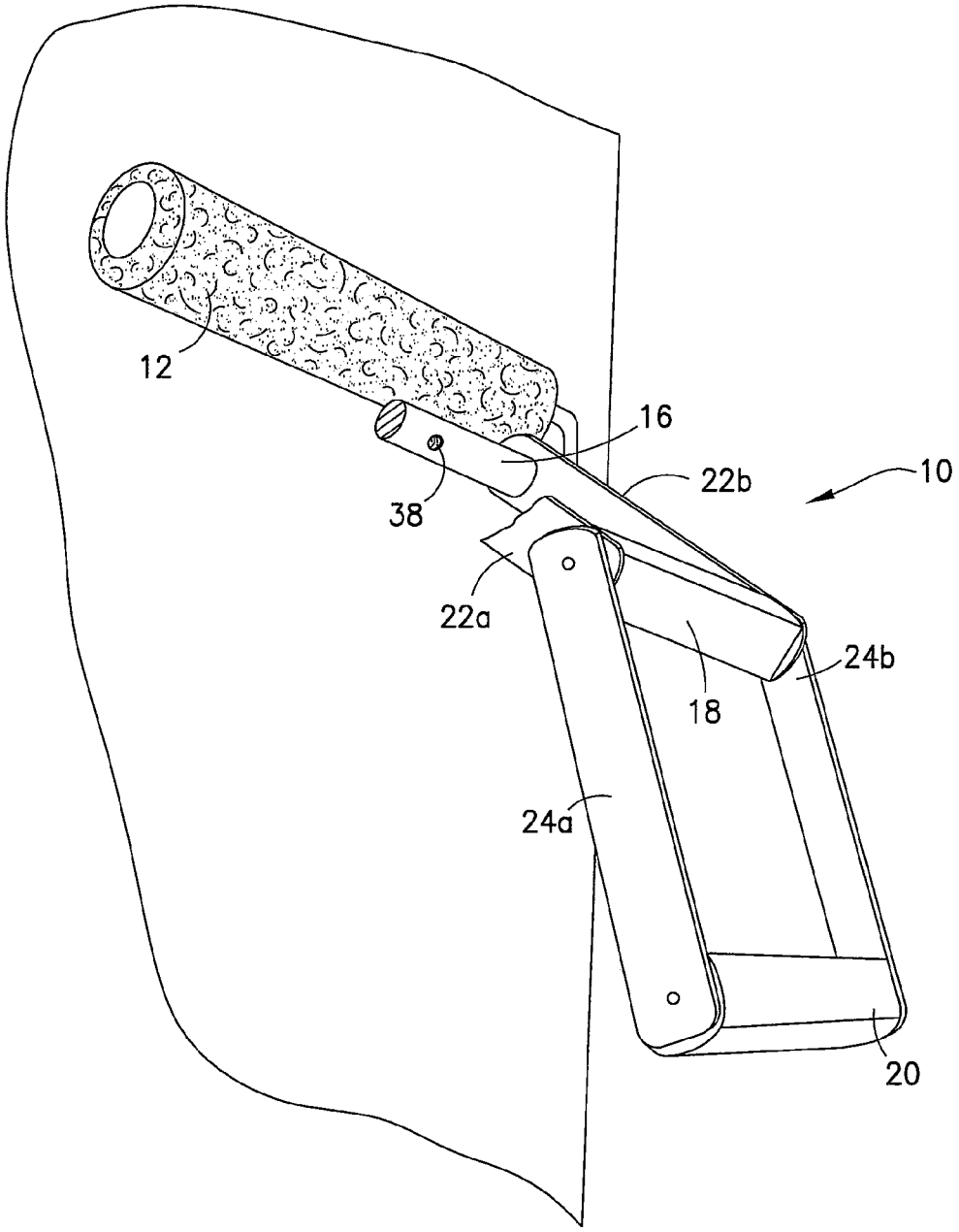
FIGS. 7A and 7B are perspective views of another embodiment of a paint roller used in conjunction with an extension pole.
Figure 7B:
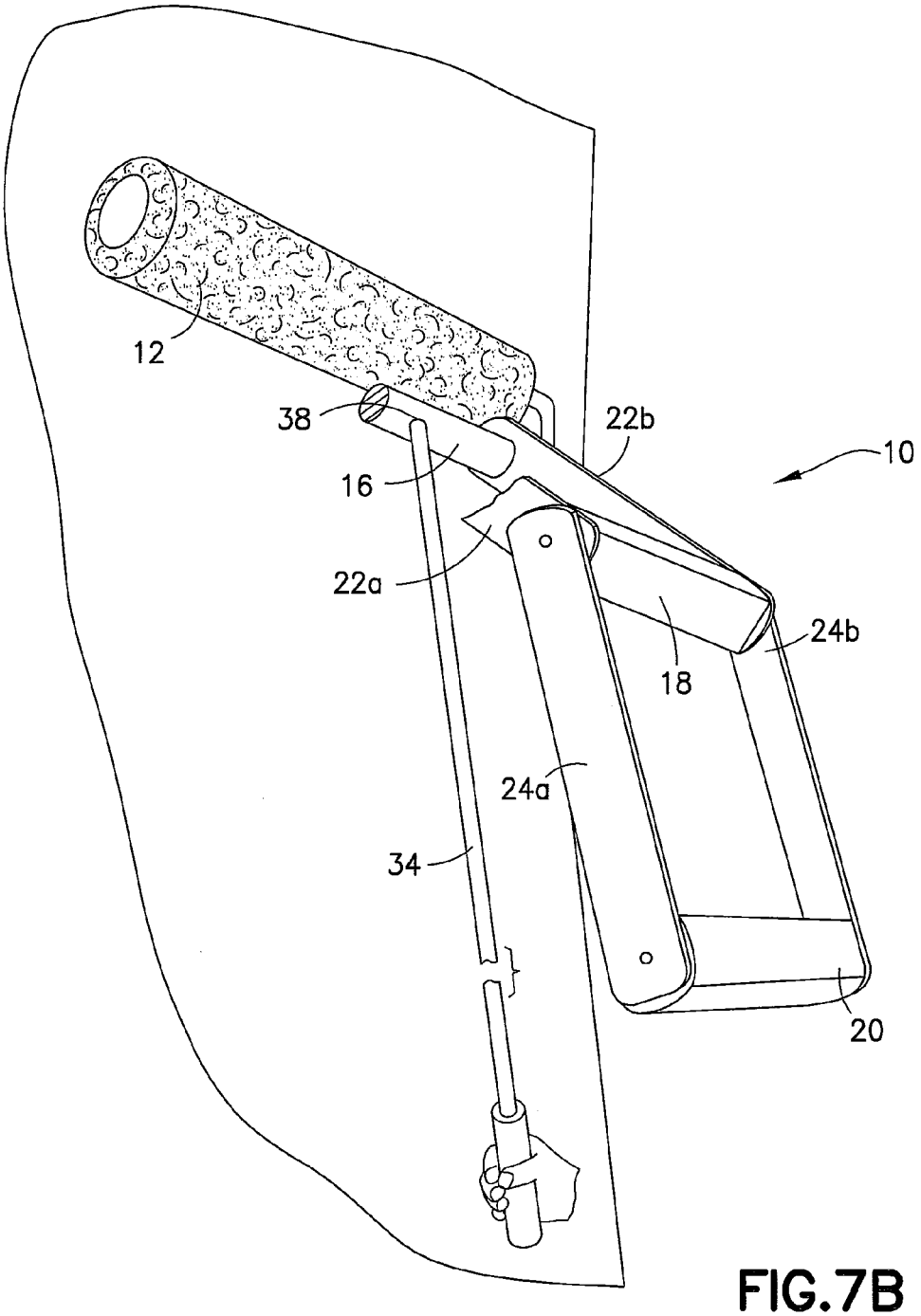

As shown in FIGS. 7A and 7B, in another embodiment of the invention, the paint roller 10 can include a different arrangement for attaching an extension pole 34 to the paint roller 10. A threaded, recessed hole 38 in the first contact member 16 can allow for the insertion of a threaded end of the extension pole 34 into the paint roller 10. By attaching the extension pole 34 to the first contact member 16, the user is given greater control over the motion of the paint roller 10. This arrangement also requires less force to be applied to the paint roller handle 28 and extension pole 34 when in operation.

Figure 8:
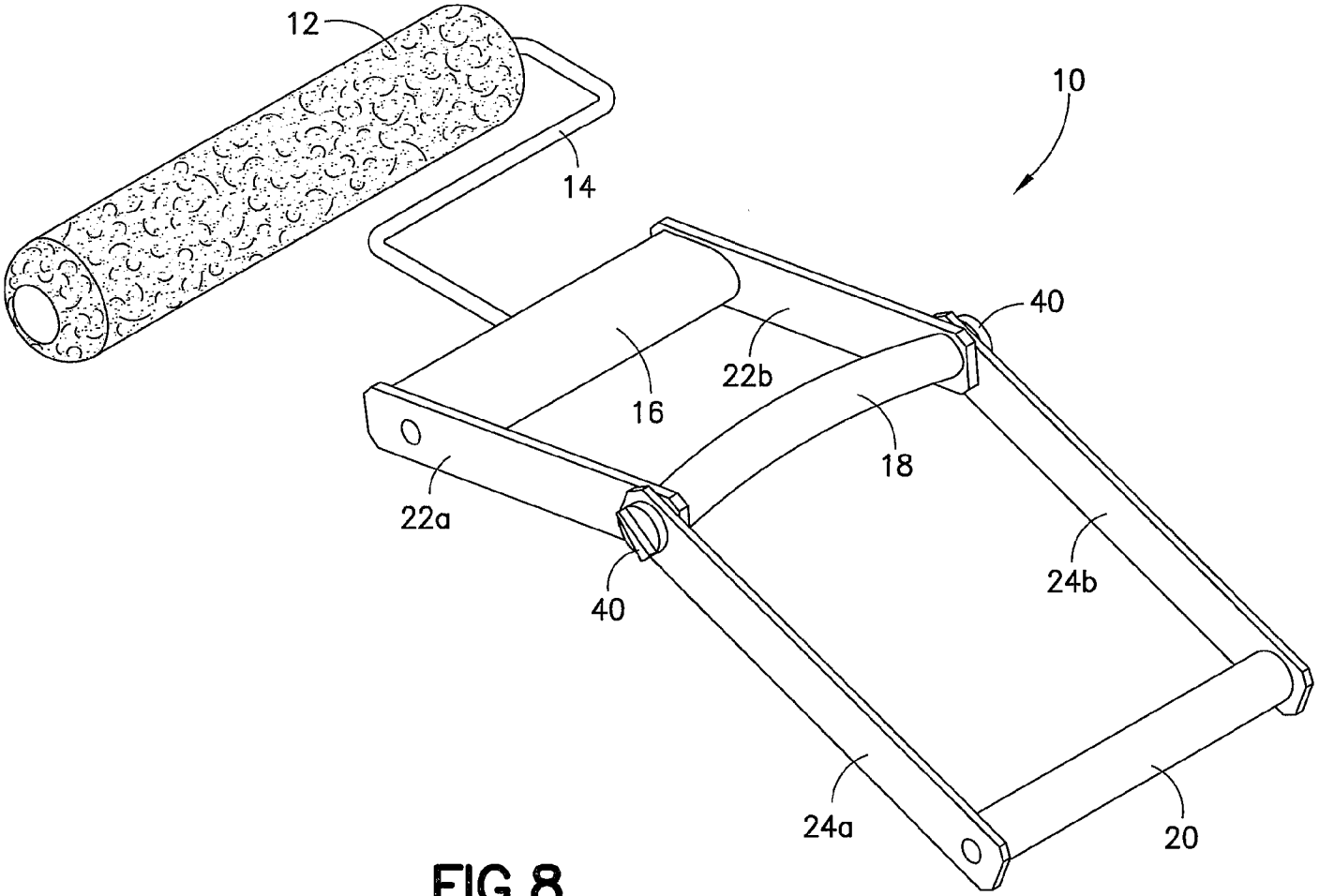
FIG. 8 is a perspective view of a paint roller with adjusting knobs positioned on the paint roller handle.

In reference to FIG. 8, adjusting knobs 40 may also be provided on the paint roller 10. A knob 40 can be threaded onto each end of the second contact member 18 and can be positioned on an outer surface of the proximal frame members 24*a*, 24*b*. The distal end of the proximal frame members 24*a*, 24*b* and the proximal end of the distal frame members 22*a*, 22*b* can be positioned between the second contact member 18 and the knobs 40. The knobs 40 can be loosened by rotating the knobs 40 in one direction. When the knobs 40 are loosened, the user can adjust the proximal frame members 24*a*, 24*b* and distal frame members 22*a*, 22*b* relative to each other so as to increase or decrease the angle between the frame members 22*a*, 22*b*, 24*a*, 24*b*. The knobs 40 can then be tightened to hold the frame members 22*a*, 22*b*, 24*a*, 24*b* in the desired position. By allowing for adjustment of the angle between the frame members 22*a*, 22*b*, 24*a*, 24*b*, the paint roller handle 28 can accommodate many different types of users and arm sizes.

Figure 9:
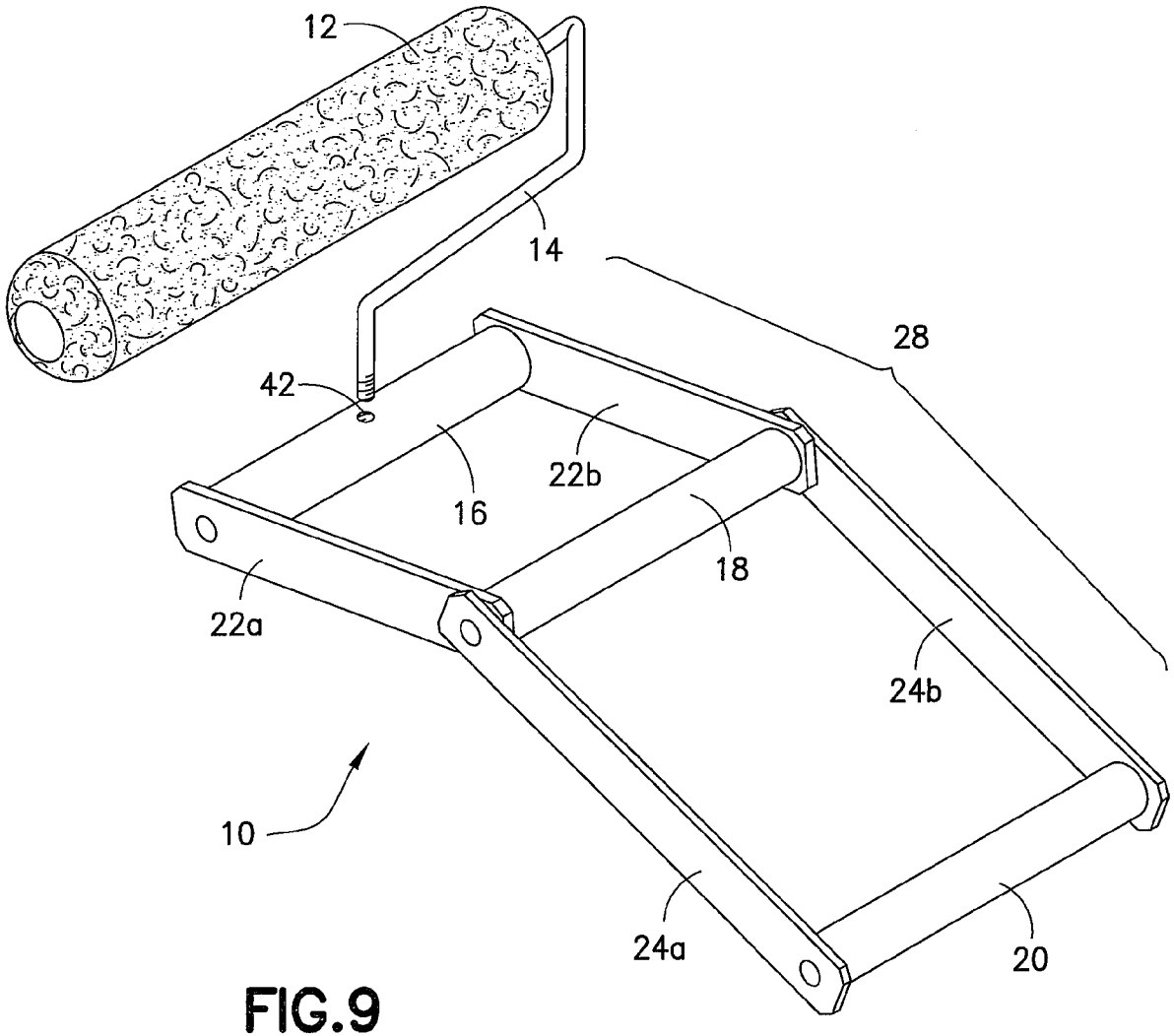
FIG. 9 is a perspective view of a paint roller with a removable paint roller frame.

As shown in FIG. 9, in another embodiment of the invention, the paint roller frame 14 can be removable from the paint roller handle 28. A threaded, recessed hole 42 can be provided on the first contact member 16, which allows for the insertion and removal of a threaded end of the paint roller frame 14. By using this arrangement, the paint roller frame 14 can be easily removed from the paint roller handle 28 to clean the paint applicator 12, replace the paint applicator 12, or to provide a different sized paint applicator 12. The paint roller 10 allows for different sized paint applicators 12 to be used on the paint roller frame 14. Paint applicators 12 with a larger/smaller diameter and/or width can be selected and used according to the type of surface that needs to be painted and the location of the surface.

Figure 10A:
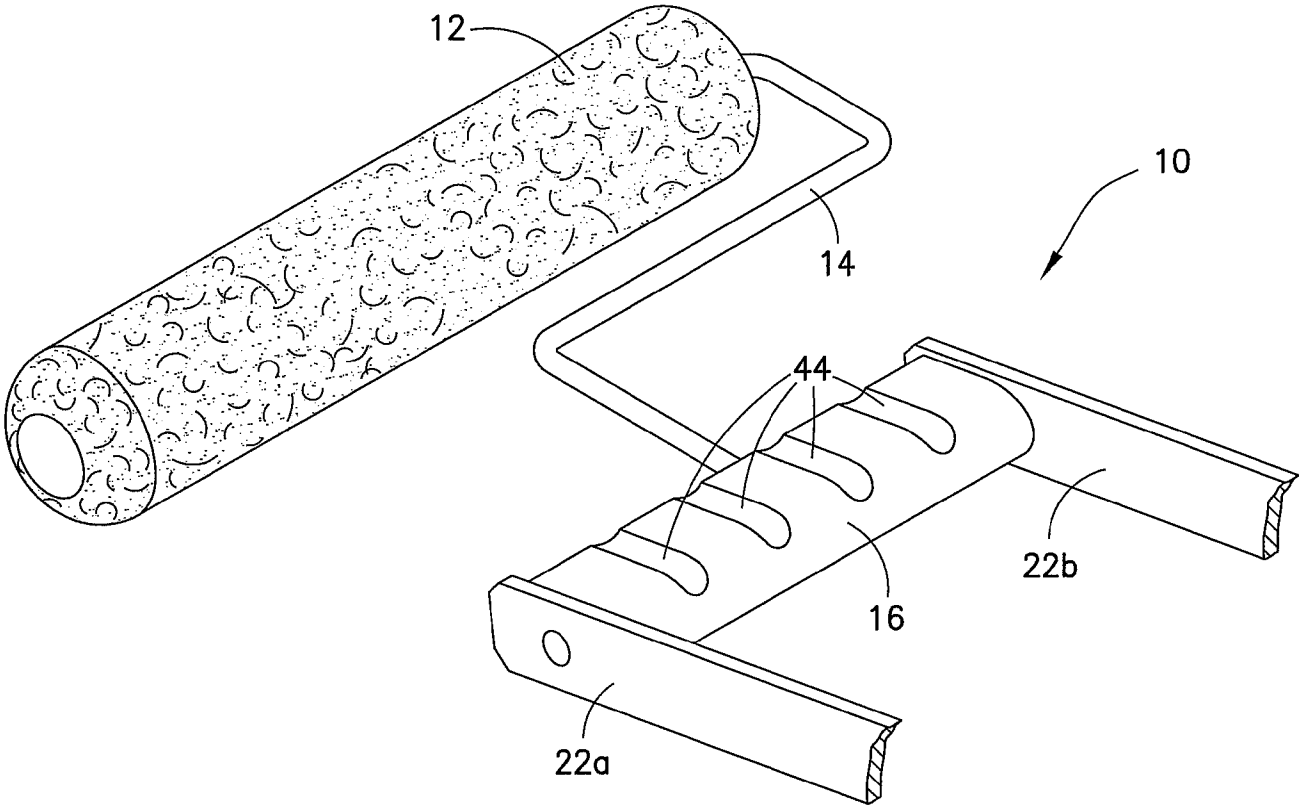
FIGS. 10A and 10B are perspective views of a paint roller with finger grip indentations on the paint roller handle.
Figure 10B:
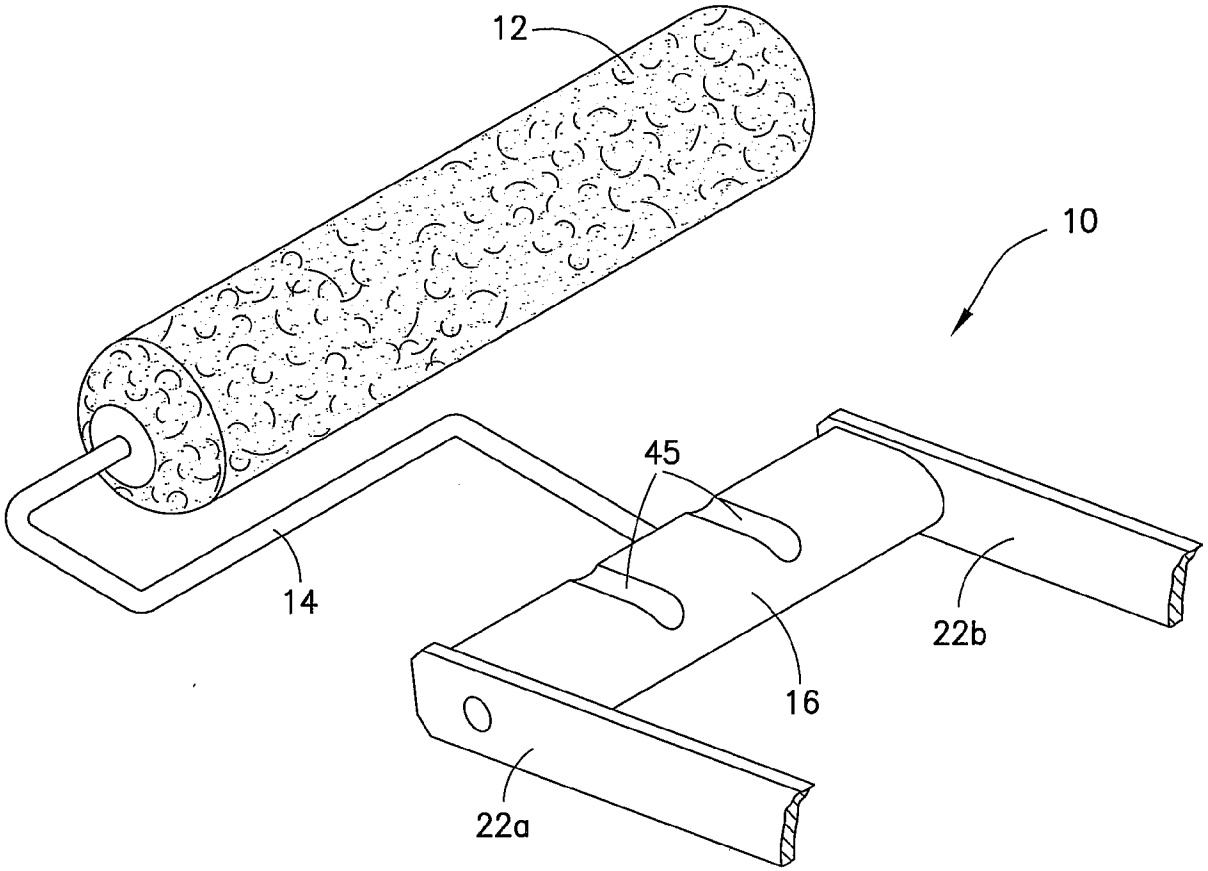

Another embodiment of the paint roller 10 is shown in FIGS. 10A and 10B. This embodiment includes finger grip indentations 44 on the first contact member 16. The tops of the indentations 44 are flush with the surface of the first contact member 16, while the indentations 44 themselves extend into the first contact member 16. In one embodiment, four indentations 44 can be included on a top surface of the first contact member 16 to accommodate the fingers of the user, while an additional indentation 45 can be included on a bottom surface of the first contact member 16 to accommodate the thumb of the user. The bottom surface of the first contact member 16 can include either one indentation 45 for a right-handed user or a left-handed user, or two indentations 45 to accommodate both right-handed and left-handed users. The finger grip indentations 44, 45 provide improved ergonomics to relieve the stress placed on a user's wrist and/or forearm and provide a secure grip for the user during operation of the paint roller 10.

While an embodiment of a paint roller is shown in the accompanying figures and described hereinabove in detail, other embodiments will be apparent to, and readily made by, those skilled in the art without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A paint roller handle, comprising:

a first contact member positioned on a distal end of at least one distal frame member, the first contact member being configured to be gripped by a user during use of the paint roller handle;

a second contact member positioned on a proximal end of the at least one distal frame member, the second contact member being configured to contact an upper surface of a user's forearm during use of the paint roller handle;

a third contact member positioned on a proximal end of at least one proximal frame member, the third contact member being configured to contact a lower surface of the user's forearm during use of the paint roller handle; and an attachment member, with a threaded hole adapted for coupling to an extension pole, positioned on a surface of one of the contact members, wherein the proximal end of the at least one distal frame member is positioned on a distal end of the at least one proximal frame member, wherein the at least one distal frame member is formed integral with the at least one proximal frame member, and wherein a longitudinal length of the at least one distal frame member is fixed at an angle relative to a longitudinal length of the at least one proximal frame member.

2. The paint roller handle as claimed in claim 1, wherein the first contact member is a cylindrical grip, and wherein at least one of the second contact member and the third contact member is cylindrical.

3. The paint roller handle as claimed in claim 1, wherein the at least one distal frame member is continuous and integral with the at least one proximal frame member, and the second distal frame member is continuous and integral with the second proximal frame member.

4. A paint roller, comprising:

a paint roller handle coupled to a proximal end of a paint roller frame; and a paint applicator positioned on a distal end of the paint roller frame, wherein the paint roller handle comprises:

a first contact member positioned on a distal end of at least one distal frame member, the first contact member being configured to be gripped by a user during use of the paint roller;

a second contact member positioned on a proximal end of the at least one distal frame member, the second contact member being configured to contact an upper surface of a user's forearm during use of the paint roller;

a third contact member positioned on a proximal end of at least one proximal frame member, the third contact member being configured to contact a lower surface of the user's forearm during use of the paint roller; and an attachment member, with a threaded hole adapted for coupling to an extension pole, positioned on a surface of one of the contact members, wherein the proximal end of the at least one distal frame member is positioned on a distal end of the at least one proximal frame member, wherein the at least one distal frame member is formed integral with the at least one proximal frame member, and wherein a longitudinal length of the at least one distal frame member is fixed at an angle relative to a longitudinal length of the at least one proximal frame member.

5. The paint roller as claimed in claim 4, wherein the first contact member is a cylindrical grip, and wherein at least one of the second contact member and the third contact member is cylindrical.

6. The paint roller as claimed in claim 4, wherein the at least one distal frame member is continuous and integral with the at least one proximal frame member, and the second distal frame member is continuous and integral with the second proximal frame member.

* * * * *